United States Patent [19]

Kortmann et al.

[11] Patent Number: 4,833,188

[45] Date of Patent: May 23, 1989

[54] HYDROPHOBIC AND OLEOPHOBIC FINISHES

[75] Inventors: Wilfried Kortmann, Hagen; Wulf von Bonin; Friedrich Reich, both of Leverkusen, all of Fed. Rep. of Germany

[73] Assignee: Bayer Aktiengesellschaft, Leverkusen, Fed. Rep. of Germany

[21] Appl. No.: 57,405

[22] Filed: Jun. 2, 1987

[30] Foreign Application Priority Data

Jun. 13, 1986 [DE] Fed. Rep. of Germany ..... 3620033

[51] Int. Cl.[4] ..... C08K 5/20; C08L 33/16

[52] U.S. Cl. ..... 524/217; 524/544; 106/2; 252/8.8

[58] Field of Search ..... 524/217, 544; 252/8.8; 106/2

[56] References Cited

U.S. PATENT DOCUMENTS

| | | | |
|---|---|---|---|
| 2,937,098 | 5/1960 | Geen | 524/217 |
| 3,441,531 | 4/1969 | Koblitz | 524/217 |
| 3,462,296 | 8/1969 | Raynolds | 524/544 |
| 3,834,126 | 7/1974 | Katsushima | 524/217 |
| 4,668,726 | 5/1987 | Howells | 232/8.8 |
| 4,703,000 | 10/1987 | Hodgins | 252/8.8 |

FOREIGN PATENT DOCUMENTS

| | | | |
|---|---|---|---|
| 0008761 | 11/1981 | European Pat. Off. . | |
| 3515479 | 10/1986 | Fed. Rep. of Germany . | |
| 3515480 | 10/1986 | Fed. Rep. of Germany . | |
| 3527976 | 2/1987 | Fed. Rep. of Germany . | |
| 46-28297 | 8/1971 | Japan | 524/217 |
| 711404 | 6/1954 | United Kingdom . | |

*Primary Examiner*—C. Warren Ivy

*Attorney, Agent, or Firm*—Sprung Horn Kramer & Woods

[57] ABSTRACT

Waterproofing and oil-proofing agents contain A. compounds containing a perfluoroalkyl group, and B. quaternization products of basic fatty acid amides.

5 Claims, No Drawings

HYDROPHOBIC AND OLEOPHOBIC FINISHES

The invention relates to waterproofing and oil-proofing agents which contain

A. compounds containing a perfluoroalkyl group, and

B. quaternization products of basic fatty acid amides, a process for textile finishing using these agents, and the use of quaternization products of basic fatty acid amides as extenders in processes for textile finishing using compounds according to A.

Those compounds which are known as waterproofing and oil-proofing agents may be used as compounds A. containing perfluoroalkyl groups. These are preferably compounds having a perfluoroalkyl radical having 2–20 carbon atoms. The perfluoroalkyl radical may be interrupted by an intermediate member, for example oxygen, and may be linked to a reactive or polar support group or to the chain of a polymer. Both the support group and the polymer serve to make it possible to convert the inert fluorohydrocarbon radical as support for the proofing function into a stable preparation, for example in aqueous medium, or to bring about the adhesion and permanence of the fluorohydrocarbon group on the substrate. Examples of such perfluoro compounds are perfluorocarboxylic acids or perfluorosulphonic acids, and the salts and derivatives thereof, such as amides, and (co)polymers produced from unsaturated compounds which contain the perfluoroalkyl radical mentioned, with optionally fluorine-free monomers, for example in the form of polymer dispersions or latices. Suitable unsaturated compounds having a perfluoroalkyl radical are, for example, known from U.S. Pat. No. 3,916,053.

Preferred compounds are acrylate (co)polymers having a fluorine content of 20–45, in particular 35–,% by weight. Compounds of this type are described, for example, in U.S. Pat. Nos. 3,356,628, 3,329,661, 3,752,783 and 4,296,224.

Since these fluorine compounds are expensive and must often additionally be fixed to the substrate with the aid of other auxiliaries to be incorporated into a proofing formulation, they are sometimes employed in combination with paraffin fractions or paraffin waxes and/or fatty acid esters and melamine resins, urea resins or other resins, usually based on methylol compounds, which are effective as extenders (cf., for example, Chwala/Anger: Handbuch der Textilhilfsmittel [Handbook of Textile Auxiliaries], Verlag Chemie-Weinheim-New York-1977, Page 745–747, 771).

Such formulations occasionally achieve adequate to good proofing effects on a very wide variety of substrates, even at reduced contents of fluorine components, but relatively large amounts of coating are necessary, for example in the case of wool.

However, it is desirable that the intended proofing action be achieved, not by increasing the amount of coating, but by improving the inherent phobia of the coating material or of the coating, if appropriate interacting with the substrate, of proofing material. This object can be achieved according to the state of the art by reducing the amount of the extender included, besides the fluorine compounds, in the proofing formulations, but this causes the loss of the advantages aimed at through the concomitant use of extenders and other auxiliaries.

With the quaternized basic fatty acid amides, a group of extenders has surprisingly now been found which, in combination with the fluorine compounds used for the proofing, produce proofings of surprisingly high quality and permanence on a very wide variety of substrates, and in addition allow the amount of fluorine compounds necessary to be reduced considerably.

Quaternized basic fatty acid amides are taken to mean, in particular, products of the reaction of fatty acids having more than 8 C atoms, polyamines and 0.5 to 5 equivalents of epichlorohydrin, relative to the amino group in the basic amide.

Preferred fatty acids are straight-chain or branched, saturated or unsaturated fatty acids having 12–22 carbon atoms, or mixtures thereof, in particular those having melting points above 30° C.

Preferred polyamines are polyalkylene polyamines and, in particular, polyethylene polyamine mixtures, which are obtained on reaction of dihalogenoethane with ammonia. Of these mixtures, those which comprise polyethylene polyamines having at least 3 amino groups, in particular 3–7 amino groups, are again to be mentioned. They are obtained, for example, by removing the diamine and triamine fractions by distillation from the products mentioned above of the reaction of dichloroethane and ammonia.

The basic amides are obtained therefrom by reaction of 0.75–1.5, in particular 0.8–1.1, equivalents of fatty acid per primary amino group of the polyethylene polyamine.

Quaternized basic amides B., which are preferably prepared by quaternization in aqueous medium, are described, for example, in British Patent Specification No. 711,404, and in German Offenlegungsschriften Nos. 3,515,479 and 3,527,976. Particularly preferred amides B. are known from EP-A-0,008,761 and DE-A-3,515,480. The use as paper-sizing agents of amides reacted with epichlorohydrin in aqueous medium is known from these publications.

However, the agents according to the invention serve, in particular, as textile-finishing agents. They preferably exist as aqueous dispersions. The amount ratio of A : B is, for example, 2:1 to 1:10, in particular 1:1 to 1:6, relative to the solids content. The aqueous dispersions preferably have a total solids content of 0.5–50, preferably 5–25,% by weight.

These are stable dispersions which can be marketed as such. They may contain further components, such as other textile auxiliaries, for example synthetic resins. These further components are preferably nonionic or cationic.

The aqueous dispersions may be further diluted with water before use on the textile materials. The ratio of aqueous dispersion to textile material is selected so that a coating amount of 0.5–15.0 g, preferably 0.5–5.0 g and in particular 0.5–1.5 g, of total solid of the mixture according to the invention is achieved per kg of textile material.

Surprisingly, it turned out that excellent water-proofing and oil-proofing effects can be achieved even at these relatively low coating amounts.

Natural and synthetic materials, such as fibres, filaments, yarns, nonwoven fabrics, woven fabrics and knitted fabrics, in particular of cellulose and the derivatives thereof, but also of polyester, polyamide and polyacrylonitrile materials, wool or silk, can be finished successfully using the mixtures according to the invention.

The waterproofed or oil-proofed textile structures, such as nonwoven fabrics or, in particular, woven fabrics, are used, for example, for the production of umbrella coverings, tents, water-repellent clothing or coatings, balloon envelopes, awnings, textile floor coverings, packaging materials or footwear.

The finishing is carried out by known processes, preferably by the exhaustion process or padding process, for example between room temperature and 40° C., but also by slop padding or spraying, with a downstream temperature treatment at 80–180, preferably 120°–150° C.

The observation that, on the one hand, the textile finishing agents according to the invention do not produce any advantages compared to the components B. known as paper-sizing agents with reference to the sizing action on paper, and, on the other hand, the products known as paper-sizing agents do not cause adequate textile water-proofing is of interest. This behaviour of the mixtures used according to the invention shows that the known action of the quaternized basic fatty acid amides employed as paper-sizing agents does not allow any conclusion to be drawn on their suitability as components of the proofing formulations according to the invention, although paper-sizing represents an effect which, superficially, appears to be comparable to waterproofing.

The parts and percentages specified in the following examples relate to the weight, unless otherwise stated.

Paper finishing

It is shown here that the combination of a quaternized basic fatty amide B., which is well suited for paper sizing, with a polymeric perfluoroalkane active compound A., which is used according to the state of the art for the purpose of textile waterproofing, does not produce an improvement in the ink float times or Cobb values for paper. It was thus not to be expected that this combination shows an excellent waterproofing effect in the textile sector.

An acrylate copolymer containing perfluoroalkane groups, present in approximately 15% strength aqueous dispersion and having a F content of about 40% by weight in the solid, which is used commericially for textile waterproofing is employed as dispersion A.

An approximately 15% strength aqueous dispersion, according to EP-A-0,008,761, of sizing agent G is used as dispersion B.

The dispersions A. and B. are now mixed in the weight ratio 1:2.

The following ink float times are measured during paper finishing and size testing carried out according to EP-A-0,008,761 when 0.46%, relative to the paper material, is used:

Dispersion B.: 21 seconds

Dispersion A.+B.: 16 seconds

Textile finishing

Products

The products shown below were used for the following examples in order to illustrate the improvement of the oil- and waterproofing of textiles: Quaternized basic fatty amides:

Component I: an approximately 15% strength aqueous dispersion, according to EP-A-0,008,761, of sizing agent G.

Component II: 156 parts of a hydrogenated fish oil fatty acid containing approximately 80% of behenic acid, acid number 167, solidification point approximately 67° C., are reacted with 56 parts of a coamine from approximately 40% of triethylenetetraamine, 30% of tetraehtylenepentamine and 30% of pentaethylenehexamine at 175° C. with removal of the water of reaction by distillation to form the amide. 1390 parts of water are then added with stirring, and the temperature adjusted to 80° C. 60 parts of epichlorohydrine are now stirred in. The mixture is stirred for 2 hours, and, after cooling to 50° C., a solution of 1.3 parts of NaCl in 100 parts of water is added. An approximately 15% strength dispersion is obtained.

Component III: As for component II; however, a mixture of equal parts of technical behenic acid and technical oleic acid is used as fatty acid.

Component IV: A mixture of 50% of a condensation product, prepared from 1 mole of hexamethylolmelamin pentamethyl ether, 1.5 moles of behenic acid and 0.9 mole of methyldiethanolamine at 130° C. over 3.hours, and 50% of paraffin (melting point 52° C.).

Proofing agent containing perfluoroalkyl groups:

Component V: An acrylate copolymer, containing perfluoroalkane groups, existing as a 15% strength aqueous dispersion and having a fluorine content of approximately 40% in the solid.

Commercially available synthetic resins and appropriate catalysts are used together for the surface stabilization of textile substrates of cotton and cotton/synthetic fibres or for designing the handle of PAC awning fabrics.

Synthetic resin A: Fixapret CPN (BASF)

Synthetic resin B: ACRAFIX M (Bayer)

Catalyst: Zinc nitrate

Proofing liquors, which, depending on the textile fibre substrate, contain different amounts of the components, are prepared from these components.

Test methods

After conditioning for 24 hours at 20° C.±2° C. and 65% relative atmospheric humidity, the finished textile samples are subjected to the appropriate tests.

1. The rain test is carried out in accordance with DIN 53 888 using the rain-test instrument according to Dr. Bundesmann.

Evaluation (a) Water-repulsion time in minutes (b) Water-repellent effect in grades 5–1 Grade 5 denotes the greatest water-repellent effect Grade 1 denotes the least water-repellent effect (c) Water absorption W in %

(d) Water permeation in $cm^3$

2. The waterproofing is tested in accordance with DIN 53 886 (Schopper test).

3. The oil-repulsion test is carried out in accordance with ATTCC Test Method 118–1978.

Evaluation

The grade for the repulsion of oil corresponds to the highest numbered test liquid which does not wet the fibre material within 30 seconds: Grade 1 lowest value Grade 8 highest value.

EXAMPLE 1

A cotton gabardine fabric weighing about 240 $g/m^2$ was finished on a padding mangle with the following formulations.

| | a | b | c | d | |
|---|---|---|---|---|---|
| Synthetic resin A | 60 | 60 | 60 | 60 | g/l |
| Catalyst | 4 | 4 | 4 | 4 | g/l |

-continued

| | a | b | c | d | |
|---|---|---|---|---|---|
| Component V | 20 | 20 | 20 | 20 | g/l |
| Component II | — | 20 | — | — | g/l |
| Component III | — | — | 20 | — | g/l |
| Component IV | — | — | — | 10 | g/l |

The cotton fabric was soaked, in a trough, with the abovementioned liquors and squeezed between 2 rubber rolls (padding mangle). After this, the absorption of liquors was 70%, relative to the textile weight. The sample was dried at 100° C. and treated at 150° C. for 5 minutes. The test produced the following values:

| | | a | b | c | d |
|---|---|---|---|---|---|
| 1a | Water-repulsion time (minutes) | 0 | 10 | 10 | 10 |
| 1b | Water-repellent effect (grades 5–1) | 2 | 5 | 5 | 5 |
| 1c | Water absorption (%) | 38 | 7 | 19 | 12 |
| 1d | Water permeation ($cm^3$) | 20 | 10 | 11 | 13 |
| 3 | Oil repulsion (grades 1–8) | 1 | 3 | 5 | 3 |

The evaluation shows that the amount of fluorine component V employed is too small for finishing without extender and does not produce a water-repellent effect.

The addition of components II, III and IV produces values, in the water-repulsion test (a–d), which correspond to the standard of rainwear finishing.

The components II and III claimed according to the invention produce this increase even when 3 g/l is used, relative to the solid, whereas the component IV, not according to the invention, is only active when at least 10 g/l are used.

Another serious difference is the loss of handle of the treated textile substrate: component IV does not improve the handle compared to a textile fabric treated only with component V, but, rather, influences the handle character towards the rougher, harder side.

In contrast, the components II and III cause a soft, smooth and silky handle.

It is known that, in combination with proofing agents based on fluorine, extenders increase the oil-repellent effect (for example finish formulation d). However, the increase in the effect using component III represents an improvement which cannot be achieved using the known extenders.

EXAMPLE 2

A dyed polyester/cotton poplin fabric (67% of PES/33% of cotton) weighing about 160 g/$m^2$ was finished on the padding mangle with the following formulations:

| | a | b | c | |
|---|---|---|---|---|
| Synthetic resin A | 60 | 60 | 60 | g/l |
| Catalyst | 4 | 4 | 4 | g/l |
| Component V | 20 | 20 | 20 | g/l |
| Component II | — | — | 20 | g/l |
| Component IV | — | 10 | — | g/l |

The take-up of liquor was 65%, and the subsequent treatment was carried out as described in Example 1.

The test produced the following values:

| | | a | b | c |
|---|---|---|---|---|
| 1a | Water-repulsion time (minutes) | 10 | 10 | 10 |
| 1b | Water-repellent effect (grades 5–1) | 5 | 5 | 5 |
| 1c | Water absorption (%) | 17 | 12 | 3 |
| 1d | Water permeation ($cm^3$) | 2 | 4 | 2 |
| 3 | Oil repulsion (grades 1–8) | 1 | 3 | 3 |

The finished samples were then washed 5 times at 40° C. in a Miele type W 763 washing machine using the easy-care programme with addition of a conventional household detergent, and dried at 80° C. in a Miele household drier.

| | | a | b | c |
|---|---|---|---|---|
| 1a | Water-repulsion time (minutes) | 0 | 3 | 10 |
| 1b | Water-repellent effect (grades 5–1) | 2 | 2 | 5 |
| 1c | Water absorption (%) | 32 | 24 | 12 |
| 1d | Water permeation ($cm^3$) | 15 | 15 | 0 |
| 3 | Oil repulsion (grades 1–8) | 1 | 1 | 2 |

The component II claimed according to the invention improved the fastness to washing of fluorine finishes in such a fashion that the phobia values are retained completely even after 5 machine washes, whereas the finishes without extender or with component IV fall off markedly or are no longer present.

EXAMPLE 3

The textile fabric described in Example 2 was finished by the same process and the same treatment with the following liquors.

| | a | b | c | d | |
|---|---|---|---|---|---|
| Synthetic resin A | 60 | 60 | 60 | 60 | g/l |
| Catalyst | 4 | 4 | 4 | 4 | g/l |
| Component V | 30 | 30 | 30 | 30 | g/l |
| Component I | — | — | — | 20 | g/l |
| Component IV | — | 10 | 20 | — | g/l |

Test results:

The rain test showed very good water-repulsion values over the 10 minute rain time in the case of the 4 finishes.

The rain time was then continued and the point in time determined at which the surface of the textile was completely wetted. The tests of the textile sample finished according to recipe d were terminated after 30 hours after which time the sample with the component I according to the invention exhibited absolutely no wet points and repelled water with the highest grade 5. The water-repulsion grade was determined at the same time.

| | | a | b | c | d |
|---|---|---|---|---|---|
| 1a | Water-repulsion time (hours) | 0.5 | 1 | 1.5 | 30 |
| 1b | Water-repulsion grade | 2 | 2 | 2 | 5 |

EXAMPLE 4

The textile fabric described in Examples 2 and 3 was finished by the same process and the same treatment with the following liquors:

| | | a | b | c | d | e | f | g | |
|---|---|---|---|---|---|---|---|---|---|
| Synthetic resin A | | 60 | 60 | 60 | 60 | 60 | 60 | 60 | g/l |
| Catalyst | | 4 | 4 | 4 | 4 | 4 | 4 | 4 | g/l |
| Component V | | 8 | 12 | 16 | 8 | 12 | 8 | 12 | g/l |
| Component II | | — | — | — | — | — | 20 | 20 | g/l |
| Component IV | | — | — | — | 10 | 10 | — | — | g/l |
| 1a | Water-repulsion time (minutes) | 0 | 0 | 10 | 0 | 10 | 10 | 10 | |
| 1b | Water-repellent effect (grades 5–1) | 1 | 2 | 5 | 2 | 4 | 5 | 5 | |
| 1c | Water absorption (%) | 29 | 18 | 13 | 17 | 7 | 7 | 4 | |
| 1d | Water permeation ($cm^3$) | 6 | 4 | 0 | 3 | 1 | 0 | 0 | |
| 3 | Oil repulsion (grades 1–8) | 0 | 1 | 2 | 1 | 1 | 1 | 1 | |

If the component II claimed according to the invention is also used in the finishing liquor, ideal waterproofing values are achieved with only half the amount of fluorine normally employed. The use of component IV in the finishing bath still requires 75% of the amount of fluorine.

EXAMPLE 5

The material awaiting finishing is a polyacrylic awning fabric: 290 g/$m^2$, spun-dyed, traded under the trade name DRALON (Bayer AG). The finish is applied using a padding mangle. The take-up of liquor is 75% of the fabric weight. After drying at 100° C., the awning fabric is treated at 150° C. for 4 minutes.

| | | a | b | c | |
|---|---|---|---|---|---|
| Component V | | 15 | 15 | 15 | g/l |
| Component I | | — | 20 | — | g/l |
| Component IV | | — | — | 10 | g/l |
| 1a | Water-repulsion time (minutes) | 0 | 10 | 8 | |
| 1b | Water-repellent effect (grades 5–1) | 1 | 5 | 3 | |
| 1c | Water absorption (%) | 28 | 7 | 14 | |
| 1d | Schopper value (mm water column) | 370 | 440 | 400 | |
| 3 | Oil repulsion (grades 1–8) | 4 | 5 | 4 | |

The improved rain-proofing and waterproofing values when component I is used can also be seen clearly here. The use of component IV with three times the amount of solid does not achieve the test values. In none of the cases is the oil-repulsion impaired.

EXAMPLE 6

A polyamide taffeta fabric for umbrella covering (weight/$m^2$: 70 g) is finished on a padding mangle using the following liquor formulations:

| | a | b | c | d |
|---|---|---|---|---|
| Component V | 10 | 10 | 10 | 10 |
| Component I | — | 10 | — | — |
| Component IV | — | — | 3 | 10 |

The increase in wet weight is about 62%. After drying in a drying cabinet at 100° C. for 10 minutes, the polyamide fabric was treated at 150° C. for 5 minutes.

| | | a | b | c | d |
|---|---|---|---|---|---|
| 1a | Water-repulsion time (minutes) | 8 | 10 | 0 | 10 |
| 1b | Water-repellent effect (grades 5–1) | 3 | 5 | 3 | 5 |
| 1c | Water absorption (%) | 13 | 4 | 12 | 16 |
| 1d | Water permeation ($cm^3$) | 40 | 10 | 50 | 40 |
| 3 | Oil repulsion (grades 1–8) | 6 | 6 | 6 | 6 |

The admixing of component I to the fluorine component V produces ideal rain-test values, the amount of water permeating being reduced markedly. When 3 g/l of solid are used, the combination with component IV exhibits a marked deterioration of the rain-test values (compared to component I having 1.5 g/l of solid), which is only compensated for by increasing the amount used to 10 g/l. The oil repulsion is not changed by component I.

EXAMPLE 7.

Compared to pure synthetic fibre materials, wool and wool-containing textiles require extremely large amounts of fluorine-containing products for practical waterproofing and oil-proofing.

The following example is intended to show that the formulations claimed according to the invention also exhibit good actions here.

A polyester/wool mixed fabric (45% wool and 55% polyester, weight: 311 g/$m^2$) is finished on a padding mangle as follows:

| | a | b | c | |
|---|---|---|---|---|
| Component V | 50 | 50 | 50 | g/l |
| Component II | — | 25 | — | g/l |
| Component IV | — | — | 15 | g/l |

The take-up of liquor was 75%. After drying at 100° C.m the woven fabrics are treated at 140° C. for 3 minutes.

| | | a | b | c |
|---|---|---|---|---|
| 1a | Water-repulsion time (minutes) | 0 | 10 | 3 |
| 1b | Water-repellent effect (grades 5–1) | 1 | 5 | 2 |
| 1c | Water absorption (%) | 26 | 13 | 20 |
| 1d | Water permeation ($cm^3$) | 17 | 15 | 17 |
| 3 | Oil repulsion (grades 1–8) | 5 | 5 | 5 |

Whereas no waterproofing values are achieved with fluorine component V, the admixing of component II claimed according to the invention achieves ideal rain-test values. Only a slight improvement is achieved through component IV compared to the textile fabric finished only with component V.

EXAMPLE 8

A woven wool fabric having a weight of 288 g/$m^2$ is finished with the following formulations by means of the exhaustion process:

| | a | b | c | |
|---|---|---|---|---|
| Component V | 2 | 2 | 2 | % of fabric weight |

-continued

| | a | b | c | |
|---|---|---|---|---|
| Component I | — | 2 | — | " |
| Component IV | — | — | 2 | " |

The liquor ratio (fabric weight to amount of liquor) is 1:30. The pH of the liquors is adjusted to 6 using 60% strength acetic acid.

The treatment is initially carried out at 18° C. for 20 minutes. The liquor temperature is then increased to 40° C., and the treatment is carried out for a further 20 minutes. The fabric is moved smoothly in the liquor over the entire period of time. The amount of residual moisture in the wool sample is then reduced to 30% in a water-extraction centrifuge, the samples are dried at 100° C. and then heated at 140° C. for 3 minutes.

| | | a | b | c |
|---|---|---|---|---|
| 1a | Water-repulsion time (minutes) | 0 | 10 | 0 |
| 1b | Water-repellent effect (grades 5-1) | 1 | 4 | 1 |
| 1c | Water absorption (%) | 39 | 20 | 38 |
| 1d | Water permeation ($cm^3$) | 1 | 4 | 1 |
| 3 | Oil repulsion (grades 1-8) | 5 | 6 | 4 |

Component V and the mixture V with IV produce absolutely no waterproofing effect. Very good water-repellent effects in the rain test are only shown when component I is used with component V. The oil repulsion is increased by one or 2 grades compared to recipe a or c.

Excellent results are also obtained in the tests mentioned when, in place of component I, a compound is employed which was obtained by reaction of 72 parts of epichlorohydrin (instead of 36 parts), and/or the following fluoroalkyl compounds are employed in place of component V:

U.S. Pat. No. 3;356,628, Examples 1A and 1B,

U.S. Pat. No. 3,329,661, Examples 2A, 2B, 6A and 6B,

U.S. Pat. No. 3,752,783, Examples 1a, 2a, 3a, 4a and 10a,

U.S. Pat. No. 4,296,224, Examples 1-9.

What is claimed is:

1. Waterproofing and oil-proofing agents which contain

A. a compound having a perfluoroalkyl group with 2-20 carbon atoms, which may be interrupted by oxygen, and which is bonded to a support group and B. a quaternization product of the basic fatty acid amide reaction product of 0.75 to 1.5 equivalents of fatty acids having more that 8 C atoms, with 1 primary amino equivalent of polyamines having at least three amino groups and 0.5 to 5 equivalents of epichlorohydrin, relative to the amino groups in the basic fatty acid amide, the weight ratio of A:B being 2:1 to 1:10.

2. Agents according to claim 1 which contain, as component A., acrylate (co)polymers having a fluorine content of 20-45% by weight.

3. Agents according to claim 1 which contain, as component B., products of the reaction of saturated or unsaturated fatty acids having 12-22 carbon atoms, polyalkylene polyamines and 0.5 to 5 equivalents of epichlorohydrin.

4. Agents according to claim 1 which contain, as component B., reaction products the polyalkylene polyamine components of which represent a polyethylene polyamine mixture which is obtained on the reaction of dichloroethane with ammonia and separation of the diamine and, triamine component.

5. Agents according to claim 1 which contain, as component B., epichlorohydrin reaction products which are obtained by quaternization using epichlorohydrin in aqueous medium.

* * * * *